US006095526A

United States Patent [19]

Cook, II

[11] Patent Number: 6,095,526

[45] Date of Patent: Aug. 1, 2000

[54] COLUMNAR RACE GAME

[75] Inventor: Jack D. Cook, II, Ormond Beach, Fla.

[73] Assignee: Bob's Space Racers, Inc., Daytona Beach, Fla.

[21] Appl. No.: 09/193,822

[22] Filed: Nov. 18, 1998

Related U.S. Application Data

[60] Provisional application No. 60/065,647, Nov. 18, 1997.

[51] Int. Cl.[7] ..... A63F 9/14

[52] U.S. Cl. ..... 273/349; 273/445

[58] Field of Search ..... 273/440, 445, 273/454, 459, 460, 349, 371, 374, 378, 386; 463/51, 52, 60

[56] References Cited

U.S. PATENT DOCUMENTS

| | | | |
|---|---|---|---|
| 3,336,030 | 8/1967 | Martell et al. | 273/349 |
| 5,066,014 | 11/1991 | Dobson . | |
| 5,407,212 | 4/1995 | Dobson . | |
| 5,439,230 | 8/1995 | Mendes, Jr. | 273/349 |
| 5,566,950 | 10/1996 | Senna | 463/60 |
| 5,573,243 | 11/1996 | Bartosik | 273/349 X |
| 5,669,607 | 9/1997 | Silver et al. . | |
| 5,678,823 | 10/1997 | Chaffee et al. . | |
| 5,954,338 | 9/1999 | Hampton | 273/445 X |

*Primary Examiner*—Raleigh W. Chiu
*Attorney, Agent, or Firm*—Standley & Gilcrest LLP

[57] ABSTRACT

A columnar race game having columns that move in a vertical direction. The object of the game is to hit a target causing actuation of the column in the vertical direction. The first column to reach a uppermost point activates a detection device which stops the game and signals the winner of the game.

29 Claims, 8 Drawing Sheets

COLUMNAR RACE GAME

This application claims priority to provisional application Serial No. 60/065,647 filed on Nov. 18, 1997.

BACKGROUND OF THE INVENTION

The present invention relates to the general field of arcade games, and more particularly, a columnar race game.

The present invention consists of a game that involves players shooting water, air, light or any other equivalent means at a target where activation of the target causes an entire column to rise. The first player whose column rises to a predetermined level is deemed the winner of the game. The present game is unique over known columnar games in that:

1.) it causes the rising of the entire column;

2.) consists of a unique glow rod and platform configuration;

3.) is comprised of a unique motor/pulley mechanism for causing the column of the present invention to rise; and 4.) utilizes a counter balance to allow the use of a low power step motor.

In addition to the features mentioned above, objects and advantages of the present invention will be readily apparent upon a reading of the following description.

BRIEF DESCRIPTION OF THE DRAWINGS

Novel features and advantages of the present invention, in addition to those mentioned above, will become apparent to those skilled in the art from a reading of the following detailed description in conjunction with the accompanying drawings wherein similar reference characters refer to similar parts and in which.

DETAIL DESCRIPTION OF PREFERRED EMBODIMENT(S)

The preferred system herein described is not intended to be exhaustive or to limit the invention to the precise forms disclosed. They are chosen and described to explain the principles of the invention, and the application of the method to practical uses, so that others skilled in the art may practice the invention.

Figure 1:
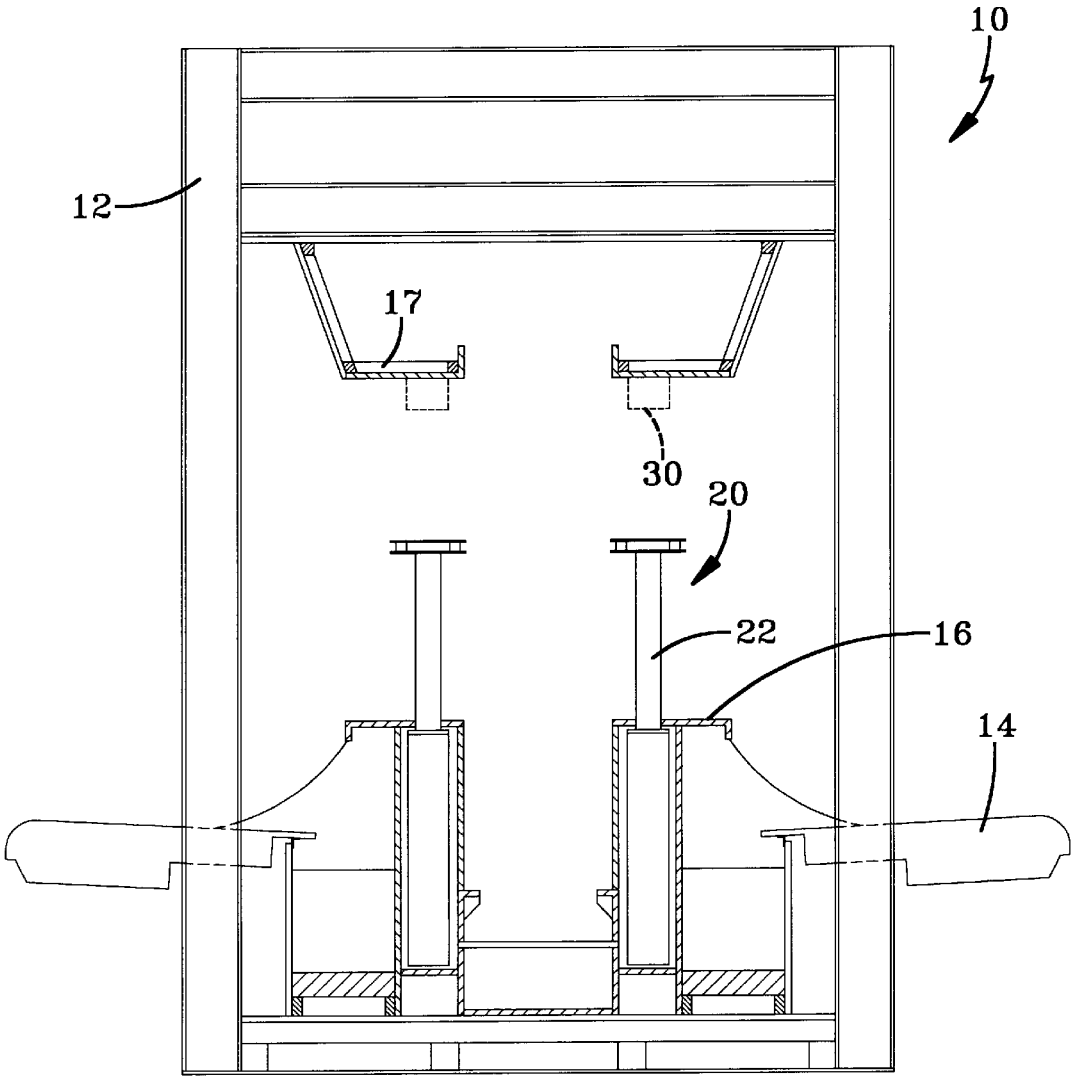
FIG. 1 illustrates an end elevational view of one embodiment of the columnar race game.

FIG. 1 illustrates an end elevational view of one embodiment of the columnar race game 10 of the present invention. Referring to FIG. 1, the game is generally supported and resides in a structure having a frame 12. A perspective view of one embodiment of the building structure and game frame

Figure 2:
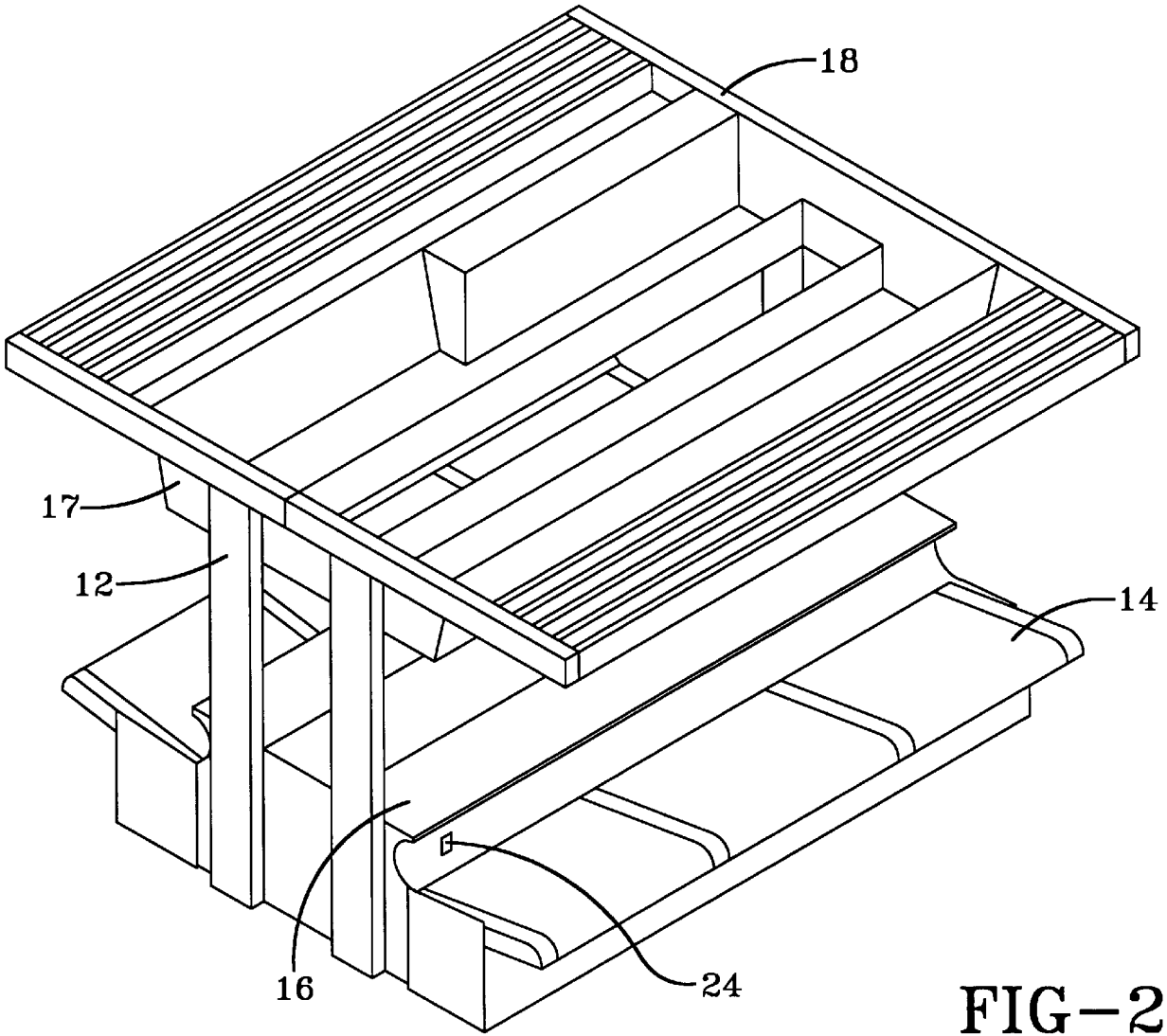
FIG. 2 illustrates a perspective view of one embodiment of the building structure and game frame.

12 is illustrated in FIG. 2. The structure is preferably comprised of a game console 14, game cabinet 16, a top ledge 17, and a roof 18.

Figure 3:
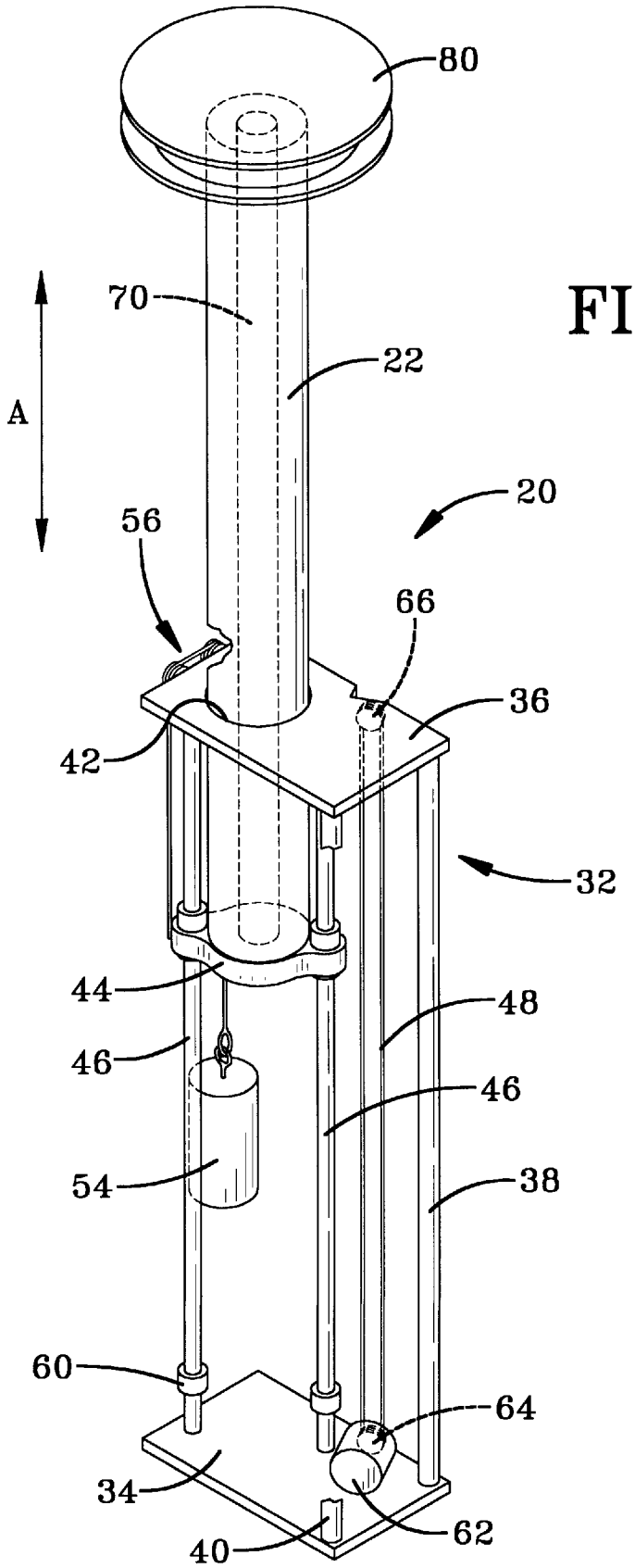
FIG. 3 illustrates one embodiment of a column structure of the present invention.

The columnar game of the present invention is comprised of a plurality of column structures 20, each having a movable column 22. FIG. 3 illustrates one embodiment of a column structure 20 of the present invention. The columns 22 are preferably adapted for movement in the vertical direction, illustrated by arrow A. The object of the game is to fire a gun or other projectile means to hit a target, or activation device, located on the game cabinet 16 (shown generally at 24). Hitting the target 24 causes actuation of the column 22 in the vertical direction from a down position to an up position. The first player having his or her column 22 reach the up position is the winner of the game. The players are preferably seated around the consoles 14 of the game structure (seats not shown in the figures).

It is appreciated that various types of targets or activation devices 24 may be used. Activation devices 24 may be formed with electronic switches, mechanical switches, optical switches, laser sensors, pressure sensors, electrical contacts, or any other device adapted to send an activation signal for controlling movement of the column 22. In a preferred embodiment, the activation device sends an electrical signal to a processing means which controls movement of the column 22. As an example, commercially available switches are available from Microswitch, Inc.

Figure 9:
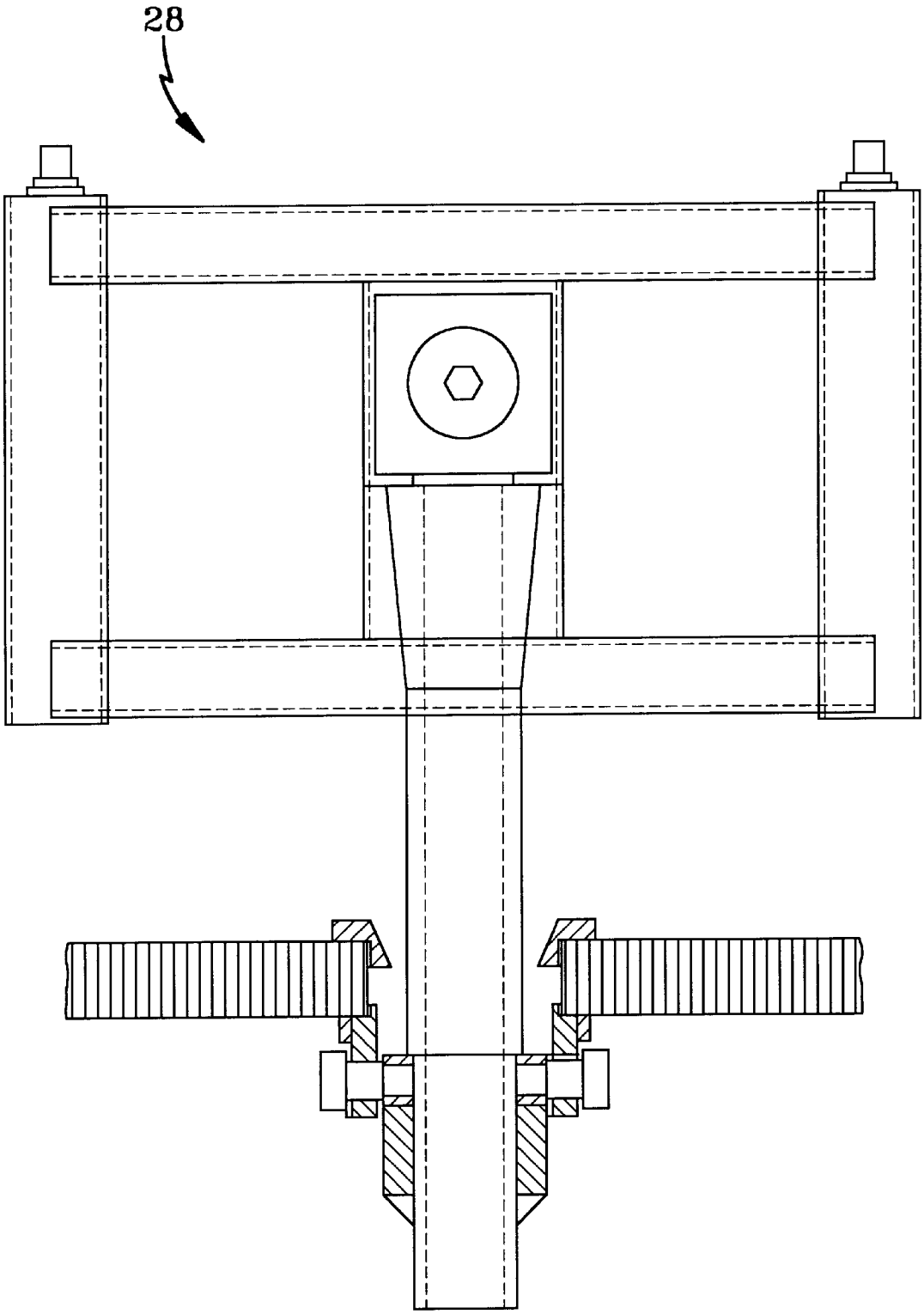
FIG. 9 illustrates a front elevational view of one embodiment of a water gun used with the present invention.

The device used to activate the activation device 24 may vary. For example, a water gun 28 may be used (FIG. 9 illustrates a front elevational view of one embodiment of a water gun used with the present invention). In other embodiments, a laser gun, an air gun, or a projectile gun may be used. In a preferred embodiment, the guns are attached on the consoles 14, one gun in front of each of the targets, or activation devices 24.

Detection devices are used in relation to each of the columns 22, for detecting when a column has reached the uppermost position. The detection device may be placed on the top ledge 17 or the cabinet 16 of the game structure. The detection device may be a switch, e.g. a microswitch, that causes activation of a signal when tripped. For example, a contact switch may be placed in relation to the column so that the column 22 activates the switch once the column 22 reaches the uppermost position. The detection device may signal another device that indicates the winner of the game. For example, flashing lights 30 may be placed in relation to each of the columns 22 to indicate a winner of the game. The detection device, when activated sends a signal to a processing system. The processing system determines which detection device was activated first and actuates the flashing lights 30 corresponding to the winner and stops the game. The processing system may be any microcontroller based system adapted to accept signals from multiple detection devices. It is appreciated that other "win" indication devices may be used such as alarms, sirens, etc.

Figure 4C:
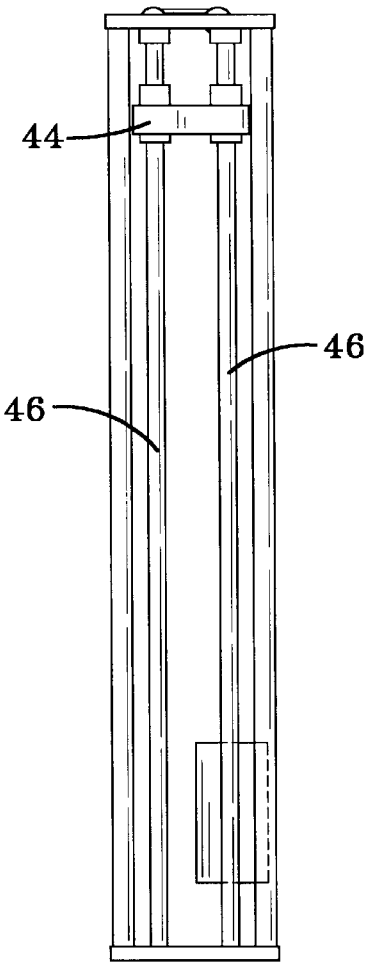
FIGS. 4A–4C illustrate various views of the slide assembly.
Figure 4B:
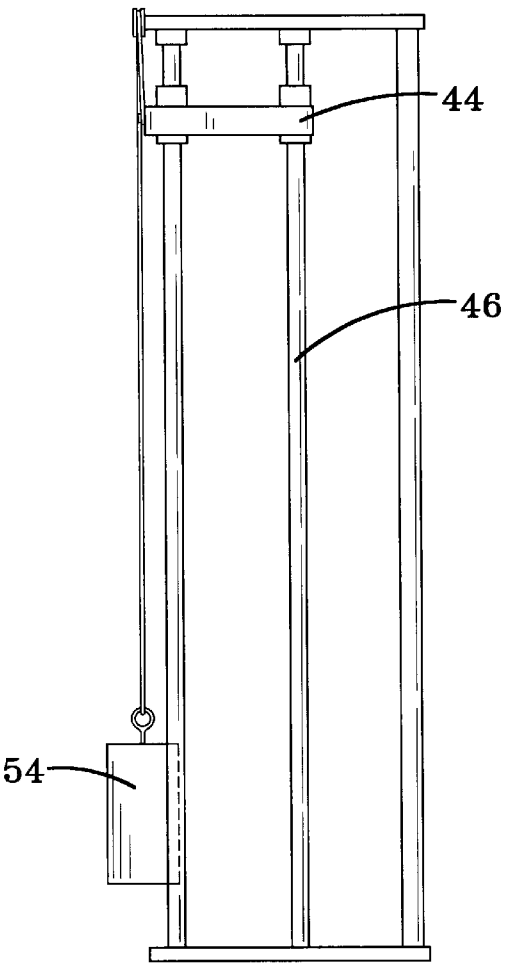
Figure 4A:
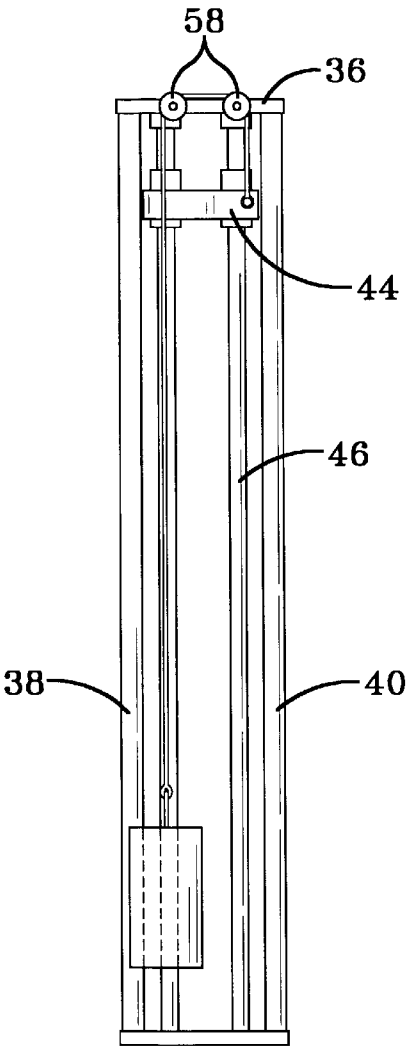
Figure 6:
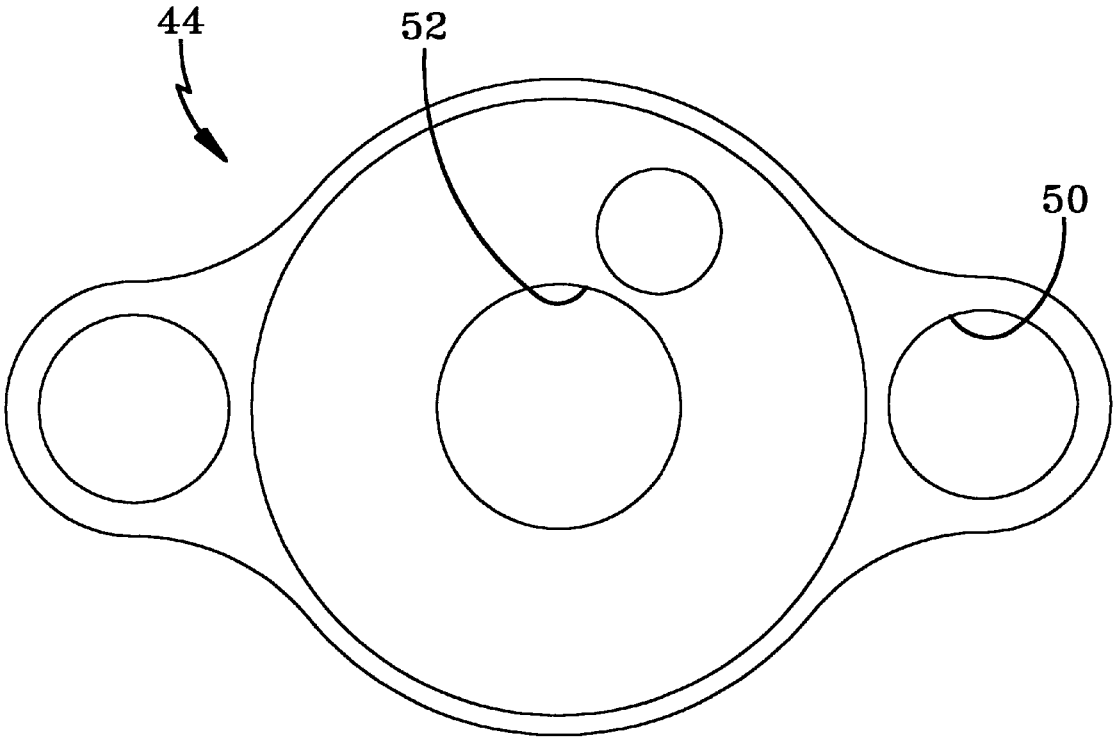
FIG. 6 illustrates a top plan view of one embodiment of the slide assembly.

Referring to FIG. 3, one embodiment of the column structure 20 of the present invention is comprised of a column 22 movable in the vertical direction. The column 22 is supported in the vertical position by a frame structure shown generally at 32. The frame structure 32 of the embodiment of FIG. 3 is comprised of a lower stand 34, an upper stand 36, and a first and second upright 38, 40. The upper stand 36 has a hole 42 in which the column 22 is disposed. In the embodiment of FIG. 3, the column 22 is attached to a slide assembly 44. The slide assembly 44 is movably attached to two slide rods 46. FIGS. 4A–4C illustrate various views of the slide assembly 44 movably attached to the slide rods 46. The slide assembly 44 has a large opening 52 for engaging the column 22 and two smaller openings 50 for engaging the slide rods 46. FIG. 6 illustrates a top plan view of one embodiment of the slide assembly 44 of the present invention.

In the embodiment of FIG. 3, the column 22 is moved in the vertical direction by a chain 48 connected to the slide assembly 44. The chain 48 is connected to a motor 62. More specifically, the chain 48 is connected to a bottom sprocket 64 and an upper sprocket 66. In the embodiment of FIG. 3, the chain is connected to a bottom plate of the slide assembly 44. The motor 62 actuates the chain 48 which causes the slide assembly 44 and column 22 to move in the vertical direction. In one embodiment, the motor 62 is a bidirectional rotary stepper motor which causes the chain 48 to move in one direction when the motor moves in a first direction and causes the chain 48 to move in a second direction when the motor 62 moves in a second direction. Various other types of motors may be used to move the columns 22.

In one embodiment, a counterbalance 54 may be attached to the slide assembly 44, e.g., using a pulley system 56. The counterbalance 54 reduces the power needed to move the column 22 in the vertical direction. The pulleys 58 may be attached to the upper stand 36. In one embodiment, stops 60 are placed on predetermined portions of the slide rods 46 to prevent further movement of the column 22 past the stops 60.

Figure 5:
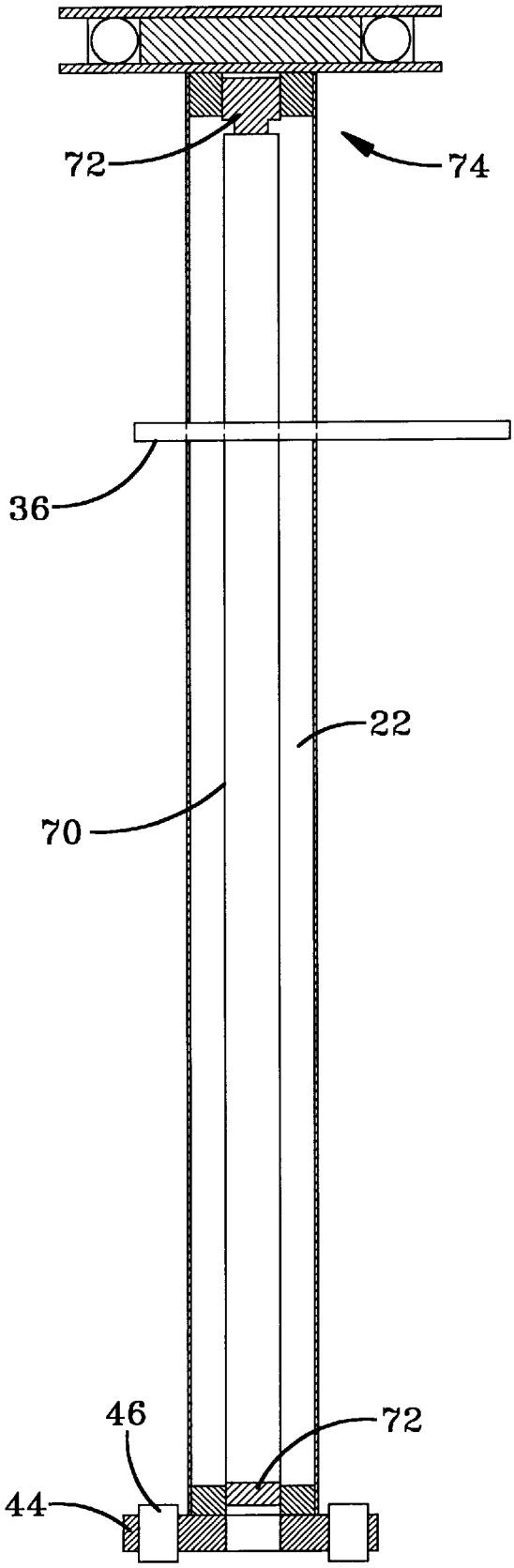
FIG. 5 illustrates one embodiment of a light disposed within a column.

In the embodiment of FIG. 3, a light 70 is disposed in the transparent column 22. FIG. 5 illustrates one embodiment of a light 70 disposed within the column 22. As illustrated, electrical sockets 72 are placed at interior ends 74 of the column 22 and the fluorescent light is disposed along the length of the column 22. The light 70 provides an aesthetically pleasing look while providing light to the game.

In the embodiment of FIG. 3, a crown assembly or platform 80 is placed at a top end of the column 22. A neon light may be placed around the platform 80. The platform 80 is substantially flat which allows the placement of a prize or other ornament on the platform 80.

It is appreciated in light of the foregoing description and the drawings that features of the column structure 20 of the present invention may be varied without departing from the spirit of the invention. For example, the column 22 may be of various shapes such as a tubular, rectangular, or any other elongated shape. A pulley system may be used to power the column 22 in the vertical direction as opposed to the chain embodiment. The slide assembly 44 may be configured in different shapes and may be movably connected in various other ways. The range of movement of the column 22 may be varied based on the length of the slide rods 46 and the location of the stops 60.

Figure 8:
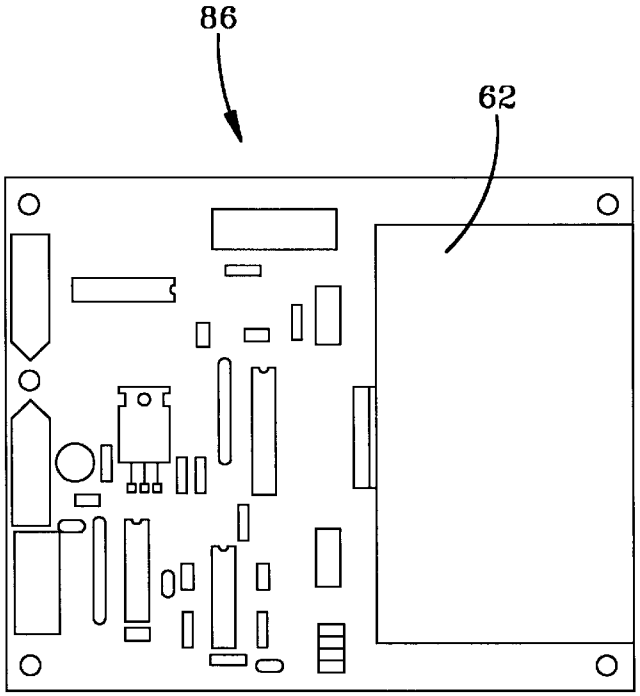
FIG. 8 illustrates one embodiment of the driver board.
Figure 7:
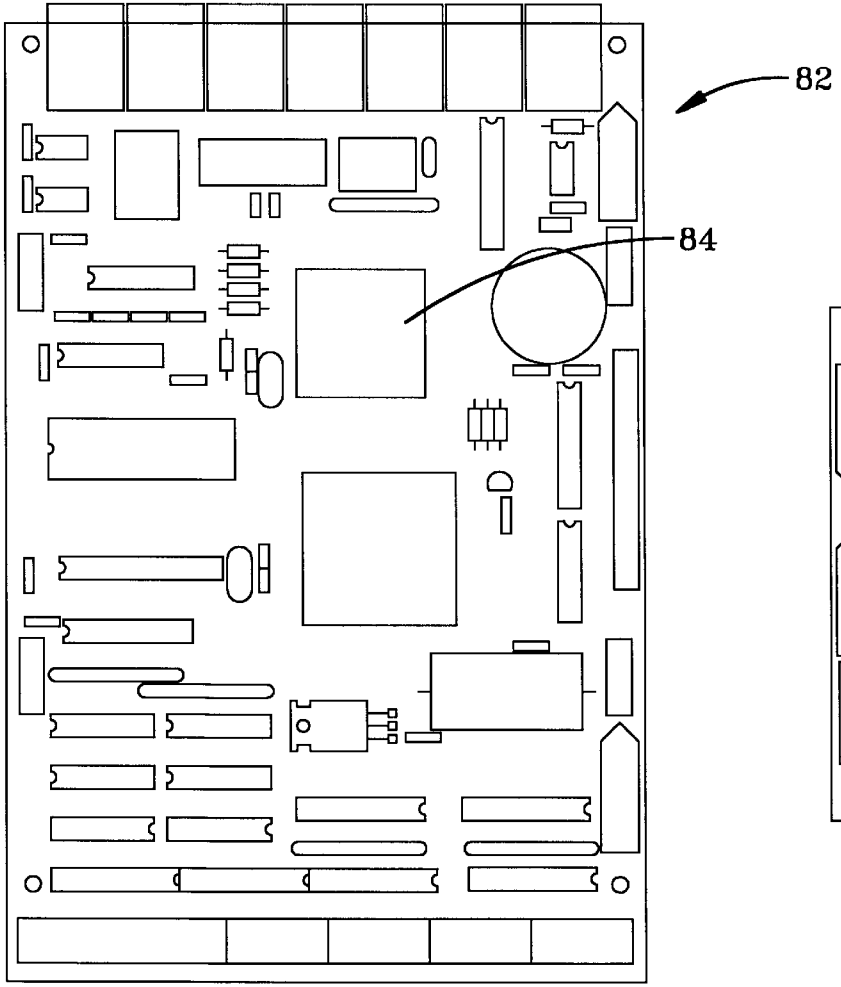
FIG. 7 illustrates one embodiment of a signal processing board.

FIG. 7 illustrates one embodiment of a signal processing board 82 of the present invention. The board 82 may be based on a microcontroller system. For example, in the board 82 shown in FIG. 7, a 68HC11 Motorola chip 84 is used. The microcontroller may be programmed to achieve the purposes of the present invention. For example, a signal from the activation device 24 (due to hitting the target) is received at the inputs of the processor board 82. The processor board 82 processes the signal and among other things sends a signal to actuate movement of the column 22. For example, the processor board 82 may send a signal to a driver board 86 which drives the motor 62. FIG. 8 illustrates one embodiment of the driver board 86 of the present invention. Although in the embodiment of FIG. 7 and 8 the processor board 82 and driver board 86 are separate, in an alternate embodiment, they may be placed on one board.

In operation, multiple players seated at the consoles 14 of the game structure use a water gun 28, or other projectile means, to actuate a target 24 or actuation means. Hitting the target 24 causes the columns 22 to rise up in the vertical direction from a down position. In one embodiment, each of the columns 22 rise up through holes located in the cabinet 16 of the game structure. The first column 22 that reaches a predetermined level, e.g., uppermost position, activates a detection means which causes actuation of a "winner" light located in relation to the column 22.

Having shown and described a preferred embodiment of the invention, those skilled in the art will realize that many variations and modifications may be made to affect the described invention and still be within the scope of the claimed invention. Thus, many of the elements indicated above may be altered or replaced by different elements which will provide the same result and fall within the spirit of the claimed invention. It is the intention, therefore, to limit the invention only as indicated by the scope of the claims.

What is claimed is:

1. A columnar race game, comprising:

a first activation device;

a second activation device;

a first column adapted for movement in the vertical direction, said first column adapted to move from a down position to an up position, wherein said first column is a clear tube of predetermined size;

a second column adapted for movement in the vertical direction, said second column adapted to move from a down position to an up position;

a first motor operationally connected to said first column for powering movement of said first column in the vertical direction;

a second motor operationally connected to said second column for powering movement of said second column in the vertical direction;

wherein said first motor drives said first column in the vertical direction when said first activation device is activated;

wherein said second motor drives said second column in the vertical direction when said second activation device is activated; and means for indicating which of said first or second column reaches said up position first.

2. A columnar race game, comprising:

a first activation device;

a second activation device;

a first column adapted for movement in the vertical direction, said first column adapted to move from a down position to an up position, wherein said first column is a clear tube of predetermined size;

a second column adapted for movement in the vertical direction, said second column adapted to move from a down position to an Up position;

a first means for powering movement of said first column in the vertical direction;

a second means for powering movement of said second column in the vertical direction;

wherein said first means for powering movement of said first column moves said first column in the vertical direction when said first activation device is activated;

wherein said second means for powering movement of said second column moves said second column in the vertical direction when said second activation device is activated; and means for indicating which of said first or second column reaches said up position first.

3. A columnar race game according to claim 2, further comprising:

means disposed in relation to said first column for detecting when said first column reaches said up position.

4. A columnar race game according to claim 2, further comprising:

means disposed in relation to said second column for detecting when said second column structure reaches said up position.

5. A columnar race game according to claim 4, wherein said means disposed in relation to said first column for detecting when said first column reaches said up position is an electrical contact.

6. A columnar race game according to claim 4, wherein said means disposed in relation to said first column for detecting when said first column reaches said up position is a motion detector.

7. A columnar race game according to claim 4, wherein said means disposed in relation to said first column for detecting when said first column reaches said up position is a magnetic device.

8. A columnar race game according to claim 2, wherein said means for indicating which of said first or second column reaches said up position first are lights disposed next to each of said columns.

9. A columnar race game according to claim 2, wherein said means for indicating which of said first or second column reaches said up position first are sirens.

10. A columnar race game according to claim 2, further comprising an elongated light source disposed in said tube.

11. A columnar race game according to claim 2, further comprising:

a platform disposed on a top end of said columns, said platform substantially flat so as to allow placement of a prize.

12. A columnar race game according to claim 2, wherein said activation devices arc electronic switches.

13. A columnar race game according to claim 2, wherein said activation devices are mechanical switches.

14. A columnar race game according to claim 2, wherein said activation devices are electrical contacts.

15. A columnar race game according to claim 2, wherein each of said means for powering movement of said columns is comprised of:

a motor; and a means connected to said motor and one of said columns for transferring movement of said motor to said one column, wherein said one column moves in an up direction when said motor moves in a first predetermined direction and wherein said one column moves in a down direction when said motor moves in a second predetermined direction.

16. A columnar race game according to claim 15, wherein said motor is a low power motor and wherein a counterbalance is connected to said column via a pulley system.

17. A columnar race game according to claim 2, further comprising:

first means for activating said first activation device.

18. A columnar race game according to claim 17, wherein said first means for activating said first activation device is a water gun.

19. A columnar race game according to claim 17, wherein said first means for activating said first activation device is a laser.

20. A columnar race game according to claim 17, wherein said first means for activating said first activation device is an air gun.

21. A columnar race game according to claim 2, wherein said activation means are optical switches.

22. A columnar race game according to claim 2, further comprising:

a console; and a cabinet structure having an upper platform having holes in which said columns are disposed.

23. A columnar race game according to claim 2, further comprising a shield disposed around at least one of said holes in said cabinet for preventing the further movement of one of said columns in the down direction.

24. A columnar race game according to claim 2, wherein said column is further comprised of:

a slide platform; and wherein said first means for powering movement of said first column structure is connected to said slide platform and moves said slide platform up and down in the vertical direction.

25. A columnar race game according to claim 1, further comprising:

a processing circuit for receiving signals from said first activation device and for controlling said first means for powering movement of said first column.

26. A method for providing a columnar race game, comprising the steps of:

providing a first column adapted to move in the vertical direction from a down position to an up position;

providing a second column adapted to move in the vertical direction from a down position to an up position;

activating a first activation device;

raising said first column in the vertical direction upon activation of said first activation device;

activating a second activation device;

raising said second column in the vertical direction upon activation of said second activation device;

indicating which of said columns reaches said up position first;

disposing a platform on an end of said first column; and placing a prize on said platform.

27. A method according to claim 26, wherein said first column is a transparent tube and further comprising the step of:

placing a light within said first column.

28. A method according to claim 26, further comprising the steps of:

providing a console;

providing a cabinet having at least two holes; and disposing said first column in one of said holes so that said first column may move in the vertical direction in and out of said hole.

29. A method according to claim 28, further comprising the step of:

providing a shield for preventing the first column from moving further in the down direction.

* * * * *